United States Patent [19]

Craig et al.

[11] 4,204,402

[45] May 27, 1980

[54] REDUCTION OF NITRIC OXIDE EMISSIONS FROM A COMBUSTOR

[75] Inventors: Roger A. Craig, Saratoga, Calif.; Huw O. Pritchard, Bolton, Canada

[73] Assignee: The United States of America as represented by the Administrator of the National Aeronautics and Space Administration, Washington, D.C.

[21] Appl. No.: 831,632

[22] Filed: Sep. 8, 1977

Related U.S. Application Data

[63] Continuation of Ser. No. 684,045, May 7, 1976, abandoned.

[51] Int. Cl.[2] ..... F02C 7/22

[52] U.S. Cl. ..... 60/39.06; 60/733; 60/746

[58] Field of Search ..... 60/39.74 R, 39.65, 39.06, 60/DIG. 11, 39.71; 431/10, 8; 239/419, 419.3, 419.5

[56] References Cited

U.S. PATENT DOCUMENTS

| | | | |
|---|---|---|---|
| 3,729,285 | 4/1973 | Schwedersky | 60/DIG. 11 |
| 3,730,668 | 5/1973 | Iida et al. | 431/10 |
| 3,746,498 | 7/1973 | Stengel | 431/10 |
| 3,788,065 | 1/1974 | Markowski | 60/39.74 R |
| 3,872,664 | 3/1975 | Lohmann et al. | 60/39.65 |
| 3,925,002 | 12/1975 | Verdouw | 431/10 |
| 3,946,553 | 3/1976 | Roberts | 60/39.74 R |
| 4,062,182 | 12/1977 | Fehler et al. | 60/39.71 |

*Primary Examiner*—Robert E. Garrett

*Attorney, Agent, or Firm*—Darrell G. Brekke; John R. Manning; Armand McMillan

[57] ABSTRACT

A turbojet combustor and method for controlling nitric oxide emissions is provided by employing successive combustion zones wherein after combustion of an initial portion of the fuel in a primary combustion zone, the combustion products of the primary zone are combined with the remaining portion of fuel and additional plenum air and burned in a secondary combustion zone under conditions that result in low nitric oxide emissions. Low nitric oxide emissions are achieved by a novel turbojet combustor arrangement which provides flame stability by allowing stable combustion, which usually result in large emissions of nitric oxide in a primary combustion zone, to be accompanied by low nitric oxide emissions resulting from controlled fuel-lean combustion, ignited by the emission products from the primary zone, in a secondary combustion zone at a lower combustion temperature resulting in low emissions of nitric oxide.

4 Claims, 4 Drawing Figures

REDUCTION OF NITRIC OXIDE EMISSIONS FROM A COMBUSTOR

The invention described herein was made, in part, by an employee of the United States Government and may be manufactured and used by or for the Government for governmental purposes without the payment of any royalties thereon or therefor.

This is a continuation of application Ser. No. 684,045filed May 7, 1976, now abandoned.

BACKGROUND OF THE INVENTION

1.Field of the Invention

This invention relates to combustors and in particular to turbojet combustors that are capable of controlling and reducing nitric oxide emissions during operation by buring a major portion of the fuel in a secondary combustion zone wherein emission products from a primary combustion zone are used as an ignition source under conditions that result in low nitric oxide emissions.

Recent environmental considerations have advanced the research for an efficient and dependable turbojet combustor that is capable of reducing and controlling nitric oxide emissions and which is at the same time resistant to problems such as flame stability and engine failure which can occur at temperatures sufficiently low to reduce nitric oxide emissions. The present invention efficiently controls such emissions while assuring flame stability by providing a secondary combustion zone in which combustion takes place at abnormally low temperatures in a novel turbojet combustor under catalyzed conditions that reduce and control nitric oxide emissions while obviating the conditions coupled with the efficient method for the control of nitric oxide emissions is particularly advantageous where thrust and/or weight considerations are important such as in jet aircraft or light automobiles.

2. Description of the Prior Art

It is known in the combustor art that operation of a combustor at or near stoichiometric fuel-air proportions results in a combustion that is resistant to flame-out characteristics but results in the undesirable emission of high quantities of oxides of nitrogen. Combustion at substantially less than stoichiometric proportions results in lower nitric oxide emissions as a result of lower combustion temperatures but these conditions encourage engine failure due to flame-outs.

Work on the development of a combustor capable of controlling and reducing nitric oxide emissions has resulted in a variety of combustor designs and various methods for mixing fuel and air to control the manner and temperature of combustion. In addition, staged combustors, that is combustors having more than one fuel burning chamber, have been developed that in operation generally burn fuel in both chambers at or about stoichiometric proportions and then rely upon elaborate circulation patterns to provide a non-adiabatic process between the stages to remove or transfer heat to keep the temperatures sufficiently low to control nitric oxide emissions. Other staged combustors have employed elaborate fuel flow and air recirculation patterns in conjunction with non-adiabatic heat transfers within the combustor in an effort to reduce nitric oxide emissions.

The present invention does not rely on non-adiabatic processes or complex mixing procedures in providing a low level of nitric oxide emissions. The present invention controls nitric oxide emissions while providing flame stability by employing a novel turbojet combustor arrangement and a method of burning fuel therein. More particularly the present invention achieves its advantages by providing a multiple zone combustor and method of buring fuel therein so that a primary combustion zone is operated at fuel rich conditions to provide flame stability from which combustion products of the primary zone are introduced and used as a catalyst in a secondary combustion zone in an adiabatic process with a second portion of fuel and air introduced therein to provide a fuel-lean and low temperature combustion that controls nitric oxide emissions.

SUMMARY OF THE INVENTION

The disadvantages and limitations of the prior art are obviated by the present invention which provides an efficient and relatively uncomplicated method for controlling and reducing nitric oxide emissions from a turbojet combustor. Furthermore, the problems of flame stability are obviated by the two-zone combustor of the present invention which provides for a fuel-rich combustion in a primary combustion zone while controlling nitric oxide emissions in a secondary combustion zone.

The present invention provides a combustor having at least two combustion zones wherein a small portion of fuel is burned in a primary combustion zone at or above stoichiometric proportions producing emission products from the primary zone that are at elevated temperatures and rich in free radicals that are conducive to further combustion. These combustion products pass directly into the secondary combustion zone and are used therein as a catalyst to combust a larger portion of fuel with additional air which is introduced therein and burned at less than stoichiometric proportions to result in a reduction of nitric oxide emissions by a factor of greater than a 100 over conventional turbojet combustors. This low production of nitric oxide emissions from the secondary zone is achieved by allowing the major proportion of combustion to occur in the secondary zone and using the emission products of the primary zone partially as a catalyst to provide continuous combustion in the secondary zone to occur at or below a temperature of about 2200K.

BRIEF DESCRIPTION OF THE DRAWING

The invention will be more fully understood from the following detailed description taken in conjunction with the accompanying drawing in which.

DESCRIPTION OF THE PREFERRED EMBODIMENT

While the present invention will be described, by way of example and for convenience, with respect to a turbojet combustor having two stages in an overlapping configuration as shown schematically in FIG. 1, it will be understood by those skilled in the art that the present invention has a broad range of applicability to turbojet combustors of differing shapes and configurations.

Figure 1:
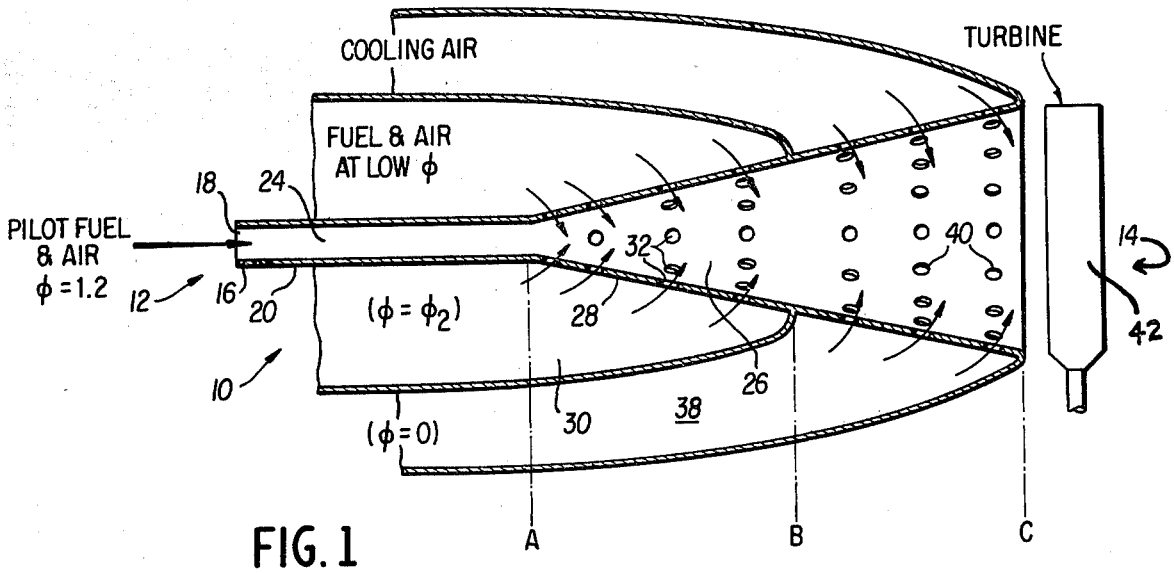
FIG. 1 is a schematic cut-away pictoral side view illustrating major elements of a preferred embodiment of a turbojet combustor in accordance with the invention.

With reference now to FIG. 1, there is shown a preferred embodiment of a turbojet combustor 10 of the present invention having an inlet opening 12 and an exhaust opening 14. Turbojet combustor 10 includes a pilot fuel and air tube 16 having an inlet end 18 and an outlet end 20 communicating with primary combustion zone 24 of about 10 cm in length and a secondary combustion zone 26 of about 20 cm in length thereby providing a combustor having a successively staged combustion area having an overall length of about 30 cm. Primary zone 24 communicates with pilot fuel and air tube 16 at its forward end and terminates at its rearward end in secondary combustion zone 26. Primary zone 24 includes means (not shown) known in the art for igniting a fuel and air mixture introduced therein, which can be ordinary spark plugs. Combustion zone 26 is conically shaped and includes an axially confronting conically shaped combustion liner 28 communicating with combustion zone 26 for supplying plenum air and fuel from chamber 30 to combustion zone 26 during operation. Combustion liner 28 has a plurality of passages 32 continuously distributed along the combustion liner such that entrained air supplied from a plenum (not shown) through chamber 30 is constant along the length of A to B in secondary combustion zone 26. Secondary combustion zone 26 uses the emissions from primary zone 24 for igniting a combustion mixture introduced therein. Air from chamber 38 introduced through holes 40 finally cools the combustion products from combustion zone 26 to prevent damage to a turbine 42 disposed therein. Energy resulting from the combustion of fuels in zones 24 and 26 respectively is translated through suitable means such as a turbine 42 which may conveniently be disposed within the combustor.

The size of the combustor and rate of fuel flow in the turbojet combustor can be of varying dimensions to suit desired performance specifications. In the preferred embodiment a turbojet combustor having a cross sectional area of about 250 square centimeters and resembling the size and flow characteristics of a Pratt & Whitney JT8D engine is used as an example.

The operation of the turbojet of the present invention provides an axisymmetric, one-dimensional and homogeneous flow of combustible materials from a pilot fuel-and-air tube 16 to the combustion zones 24 and 26 without the necessity of elaborate mixing devices and processes. In operation turbojet combustors produce nitric oxide emissions by a series of known equations of which the most prevalent are:

$$O_2 + N \rightarrow NO + O \quad (1)$$

$$N_2 + O \rightarrow NO + N \quad (2)$$

$$OH + N \rightarrow NO + OH \quad (3)$$

In the above reactions the nitric oxide formation and emissions do not become significant until the completion of the combustion process but then proceeds at an almost constant rate determined by the flame temperature and the fuel and air mixture or equilvalence ratio ($\phi$). In the following description the equivalence ratio or fuel-to-air ratio will be described using $\phi 1$ and $\phi 2$ for primary and secondary combustion zones respectively. Under fuel lean conditions in the primary zone ($\phi 1 = 0.8$) all three of the above reactions occur at a significant rate. Under stoichiometric and fuel-rich conditions ($\phi 1 = 1.2$ respectively) only the reactions numbered 2 and 3 are important. Under the fuel-rich and stoichiometric proportions the $O_2$ concentration is reduced and the reaction numbered 3 dominates the reaction numbered 1 in consuming nitrogen atoms and producing nitric oxide emission products. These emission products burned in the primary combustion zone in a range of about $\phi 1 = 0.8$ to about $\phi 1 = 1.2$ are hot and rich in free radicals which are required for the subsequent combustion of the low equivalence fuel-air mixture introduced into secondary combustion zone 26 through passages 32.

These emission products contain free radicals which are used as the ignition source for gases which are at fuel-lean conditions in the secondary combustion zone. The fuel lean combustion in the secondary zone is accomplished at an adiabatic flame temperature below 2200K the calculated freezing point for the production of nitric oxide via reactions 1, 2,and 3. Combustion of the fuel-lean mixture in the secondary zone is accomplished by adding a remaining portion of fuel premixed with air to the combustion products of the primary zone.

Figure 2:
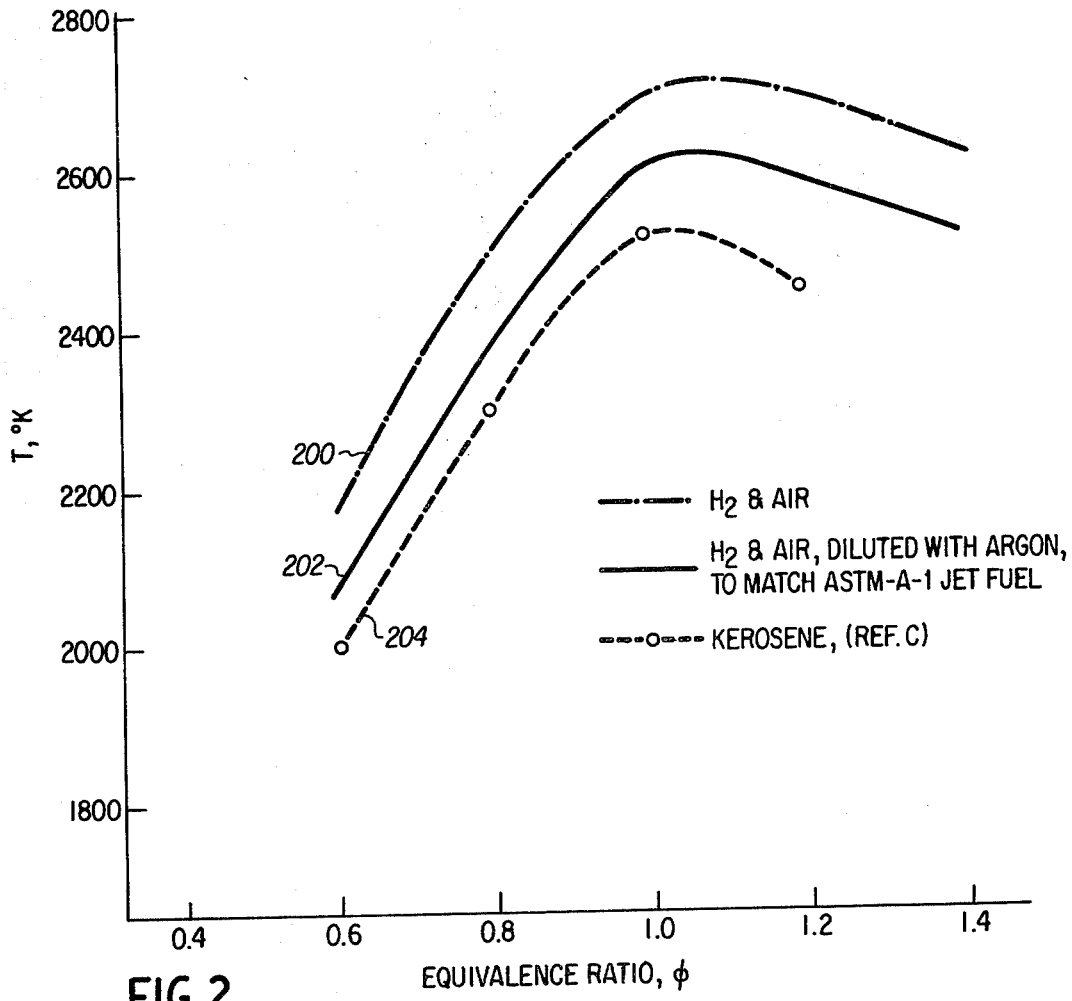
FIG. 2 is a set of curves illustrating the calculated flame temperatures and equivalence ratios for various fuel mixtures in accordance with a method of operation of the invention.

Referring now to FIG. 2, there is depicted a set of curves illustrating adiabatic flame temperatures as a function of equivalence ratios for three combustor fuels. Curve 200 depicts the adiabatic flame temperatures resulting when hydrogen is used as a turbojet fuel and burned at various equivalence ratios. Curve 202 represents the adiabatic flame temperatures resulting from the combustion of a hydrogen and air diluted with argon to match the flame temperature of ASTM-A-1jet fuel. Curve 204 represents the adiabatic flame temperatures of kerosene as a turbojet combustor fuel at various equivalence ratios.

In the preferred embodiment of the present invention fuel is divided into two portions and combustion is initiated by burning a first small portion of fuel introduced in the primary combustion zone under a fuel rich equivalence ratio ($\phi 1 = 1.2$) at an initial temperature of about 700K at a pressure of 15 atmospheres. The plenum air used in obtaining the fuel-air mixture for the secondary combustion zone is the same condition as in the primary zone, namely 700 K and 15 atmospheres.- The fuel-air mixture (introduced through 32) and cooling air (introduced through 40) are uniformly added along the axis of the combustor and the total amount of air entrained results in a total air flow of about 9575 grams per second through a turbojet combustor having an exit cross-sectional area of about 250 square centimeters. In the preferred embodiment the major portion of the combustion takes place in the secondary zone and examples are given for equivalence ratios ($\phi 2$) in the secondary zone in a range of about 0.3 to about 0.6.

Figure 3:
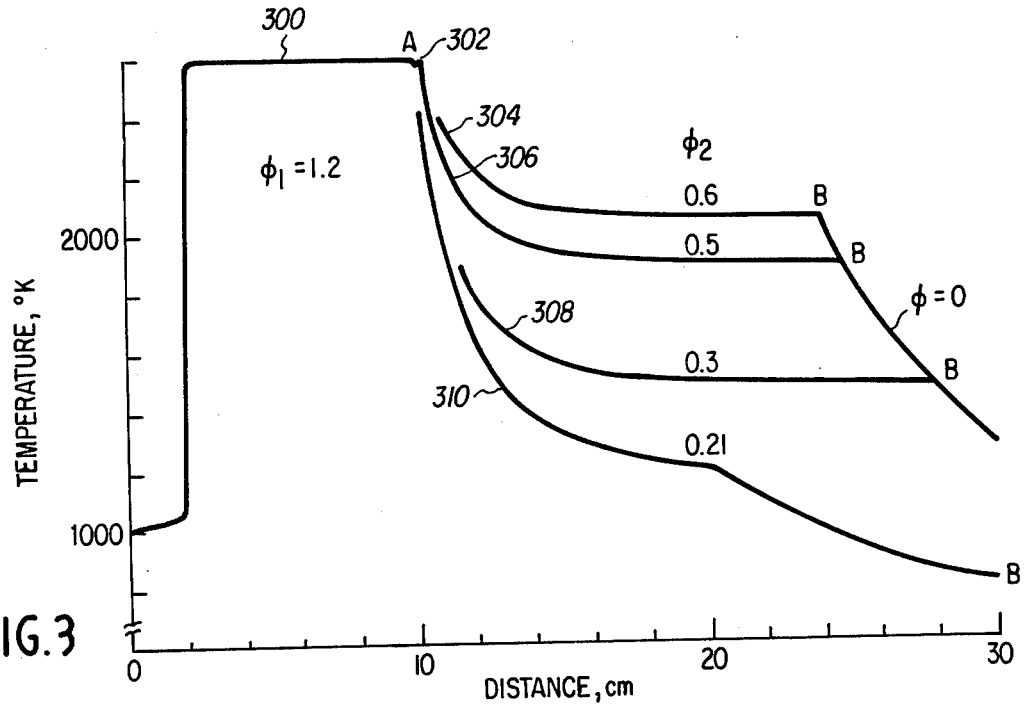
FIG. 3 is a set of curves illustrating axial variations of temperature in various zones of the combustor in accordance with the present invention.

Referring now to FIG. 3 there is illustrated a set of curves comparing axial temperature in degrees Kelvin as a function of distance in centimeters in the turbojet combustor which corresponds to various zones as heretofore described in the combustor. In FIG. 3, the first 10 centimeters corresponds to the first combustion zone (up to A in FIG. 1) and the remaining 10 to 30 centimeters corresponds to the secondary combustion zone (A–B in FIG. 1) of the novel turbojet combustor. Curve 300 to point 302 thereon corresponds to the equivalence ratio ($\phi$) of 1.2 in the 10 centimeter primary combustion zone of the turbojet combustor. Curves 304, 306, 308, and 310 respectively represent equivalence ratios ($\phi 2$) of 0.6, 0.5, 0.3, and 0.21 as related to temperature in the secondary zone of the turbojet combustor. Lower equivalence ratios in the secondary zone result in correspondingly lower combustion temperatures along with lower production of nitric oxide emissions. There is generally a lower limit to equivalence ratios in the secondary zone $\phi 2$ as an equivalence ratios of 0.21 or below results in the flame in the secondary zone to flame out because the cooling from the plenum air overwhelms the heat liberated from combustion in the secondary zone. However the design and disposition of the combustion zones and method of burning fuel of the present invention resists the upstream propagation of flame instability disturbances in the secondary combustion zone resulting from low equivalence ratios $\phi 2$.

Figure 4:
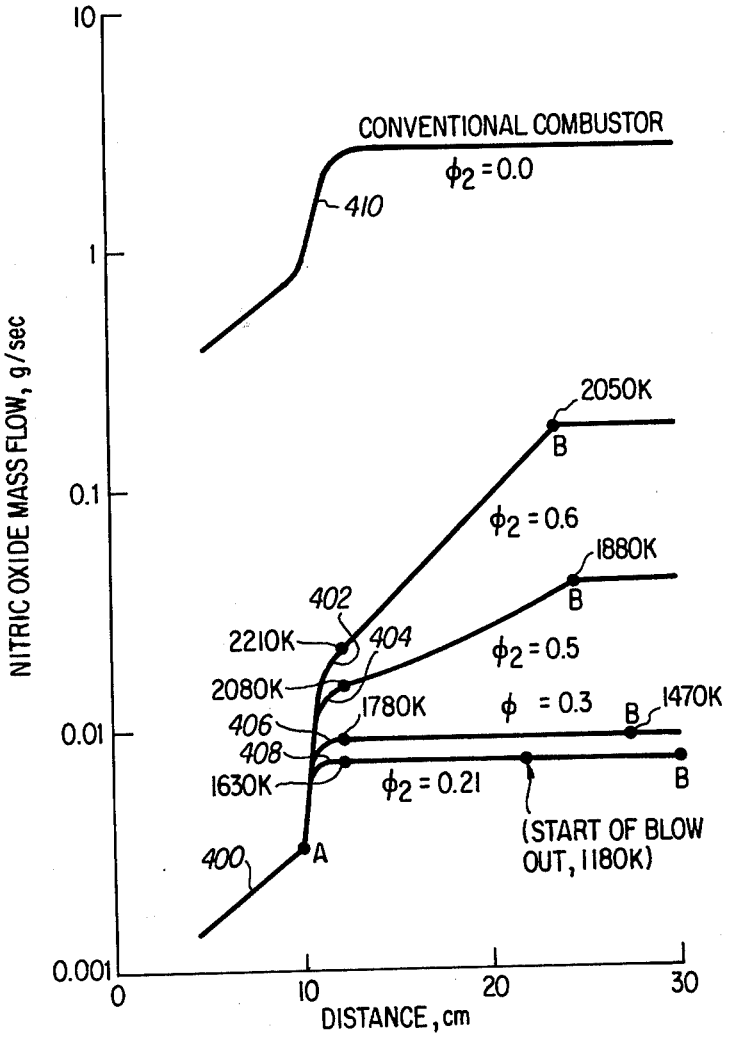
FIG. 4 is a set of curves illustrating nitric oxide flow in grams per second in the secondary zone of the combustor of the present invention together with a comparison curve for a conventional combustor.

Referring now to FIG. 4 there is illustrated the amount of nitric oxide mass flow in grams per second along the combustor at various equivalence ratios. Curve 400 at point A thereon in FIG. 4 represents the receipt in the secondary zone of nitric oxide products emitted from the primary combustion zone under fuel-rich conditions at an equivalence ratio of $\phi 1 = 1.2$. Curves 402, 404, 406, and 408 represent respectively the amount of nitric oxide mass flow along the secondary zone at equivalence ratios $\phi 2$ of 0.6, 0.5, 0.3 and 0.21 respectively in the secondary zone at the temperatures set forth in FIG. 4. Curve 410 represents the production of nitric oxide emissions from a conventional turbojet combustor (with the same operating conditions of the combustor of the present invention) and is set forth as a comparision curve from which it can be seen that the turbojet combustor of the present invention provides a reduction by over a factor of 100 of nitric oxide emissions from turbojet combustors.

At each equivalence ratio nitric oxide emissions decrease as temperature goes below about 2200° K. down the about 1630° K., and temperatures of 1630° K. and lower in the secondary combustion zone generally result in problems with flame stability. After fuel-lean combustion in the secondary zone further the required air is then added to the emission products of the secondary zone for cooling the gases (zone B to C in FIG. 1).

The method of the present invention utilizes a fuel rich combustion of an initial portion of fuel, almost in the form of a pilot light and utilizes radicals generated by the small conventional flame to reduce the induction period for the remaining fuel-air mixture to be burned in a subsequent combustion. The invention results in a stable combustion flame by preventing the upstream propagation of any disturbance in the fuel lean combustion and a substantial reduction in nitric oxide emissions from the combustor. It will be appreciated that the method of the invention can be implemented in a variety of ways by those skilled in the art to suit particular requirements which are within the scope of the invention.

What is claimed is:

1. A method for reducing oxides of nitrogen emissions in a turbojet combustor, comprising:

(a) dividing fuel to be burned into a large and a small portion;

(b) burning said small portion of fuel in a pilot combustion zone in a turbojet combustor with a sufficient quantity of air to provide stable combustion;

(c) introducing the combustion products from said pilot combustion zone to a main combustion zone is said turbojet combustor;

(d) adding adiabatically said large portion of fuel pre-mixed with a sufficient quantity of air to provide of fuel-lean combustion mixture, said addition being done at an overall rate which is progressively larger in the downstream direction of the combustor; and (e) burning said fuel-lean mixture in said main combustion zone at an adiabatic flame temperature at or below 2200° K, using said pilot zone combustion products as (a) an ignition source for the fuel-lean mixture in contract with said products, with the combustion products of said first quantity of fuel-lean mixture serving in turn to ignite the next larger quantity of fuel-lean mixture, downstream and so on until the last added fuel-lean mixture has been consumed.

2. The method of claim 1 further comprising introducing combustion products from said main combustion zone to a third zone in said turbojet for cooling said combustion gases prior to introducing said gases into a system of blades comprising a turbine.

3. A turbojet combustor for controlling nitric oxide emissions during operation, comprising:

(a) a turbojet housing having an inlet opening at one end and an exhaust opening at the other end;

(b) a pilot fuel-and-air tube forming a first combustion zone having an inlet end for receiving a first small portion of fuel and air, and an outlet communicating with (c) a main combustion zone in said turbojet housing, having a diameter increasing in magnitude in the downstream direction along the longitudinal axis of said housing, said main combustion zone being provided with means to distribute through the combustor's inner wall at an effectively increasing overall rate in the downstream direction, a second large portion of fuel premixed with air to form a fuel-lean mixture; and (d) means for igniting the materials in said first combustion zone.

4. The combustor of claim 3 wherein the means for the distribution of the fuel-lean mixture through the inner wall of the main combustion zone allow said distribution to be carried out at a substantially constant rate per unit area of said inner wall surface.

* * * * *